US006722044B2

(12) United States Patent
Timidaiski

(10) Patent No.: US 6,722,044 B2
(45) Date of Patent: Apr. 20, 2004

(54) SHEET MATERIAL CUTTING TOOL

(76) Inventor: Joseph H. Timidaiski, 1058 Manring Rd., Lawsonville, NC (US) 27022

( * ) Notice: Subject to any disclaimer, the term of this patent is extended or adjusted under 35 U.S.C. 154(b) by 15 days.

(21) Appl. No.: 10/223,102

(22) Filed: Aug. 19, 2002

(65) Prior Publication Data

US 2004/0031160 A1 Feb. 19, 2004

(51) Int. Cl.[7] ..... B26B 3/00
(52) U.S. Cl. ..... 30/338; 30/329; 30/337
(58) Field of Search ..... 30/299, 304, 329, 30/332, 286, 287, 279.2, 338, 337, 314, 315, 280, 294

(56) References Cited

U.S. PATENT DOCUMENTS 2,464,206 A * 3/1949 Becker ..... 30/304
3,270,368 A * 9/1966 Cook, Sr. et al. ..... 452/105
3,724,071 A * 4/1973 Hurtubise ..... 30/287
4,575,940 A * 3/1986 Wenzel ..... 30/335
4,578,865 A * 4/1986 Keller ..... 30/304
5,133,133 A * 7/1992 Chiba ..... 30/338

* cited by examiner

*Primary Examiner*—Hwei-Siu Payer
(74) *Attorney, Agent, or Firm*—John E. Toupal; Harold G. Jarcho

(57) ABSTRACT

A multiple receptacle blade holder tool including an elongated rectangular cross section main body with one end being rounded and having multiple rectangular receptacles for blades. The blade holder also has top and bottom surfaces parallel to the blade receptacles and a relief channel forming independent legs that clamp one or more blades in the holder.

20 Claims, 8 Drawing Sheets

SHEET MATERIAL CUTTING TOOL

BACKGROUND OF THE INVENTION

It is common practice to cover a surface or structure with sheet material for decoration, protection or reinforcement. A few examples of these applications include wallpapering and covering models of planes, boats, cars and such with a sheet material. When covering models the sheet material can be used to form a surface over a series of spaced planar ribs or bulkheads arranged to form a particular shape or contour. It is also used to cover an already existing surface of any shape or contour.

With such applications it is most desirable to trim sheet material at a uniform predetermined distance from an inside or outside line of intersection of two surfaces. This uniform line of overlap helps to ensure a lasting and aesthetically pleasing application.

At present, few tools are available for such cutting operations and they have very little adjustability. As a result, many modelers resort to gluing individual hobby blades to rectangular balsawood sticks of a certain thickness to achieve the desired overlap.

SUMMARY OF THE INVENTION

The invention is a sheet material cutting tool including a body defining a bottom guide surface; a front surface; a channel extending transversely to the bottom guide surface and intersecting the front surface; and a first leg and a second leg straddling the channel and each forming a portion of the bottom guide surface. The body also includes at least one slot defined by the first and second legs and transversely intersecting the channel, the slot being parallel to the bottom guide surface and shaped to receive the shank of a blade; and a closure actuatable to produce a force clamping the shank between the legs.

According to certain features of the invention, the front surface is convex and, radially intersected by the slot; the front surface is symmetrical around the slot; and the body has a top guide surface parallel to the bottom surface. These features facilitate desired material trimming with the tool.

According to other features of the invention, the first and second legs define a rectangular cavity for receiving the shank and the slot includes a rear portion extending rearwardly of the cavity; and the closure includes a tightening mechanism extending between the first and second legs and through the rear portion of the slot which further includes a fan-shaped portion extending between the cavity and the front surface and a transversely enlarged opening terminating an inner end of the rear portion and extending between the top surface and the bottom surface. These features further facilitate desired use of the tool.

According to an important feature of the invention, the tool includes a plurality of the slots. The plural slots greatly increase the functional flexibility of the tool.

DESCRIPTION OF THE DRAWINGS

These and other objects and features of the invention will become more apparent upon a perusal of the following description taken in conjunction with the accompanying drawings wherein.

DETAILED DESCRIPTION OF THE PREFERRED EMBODIMENT

Figure 3:
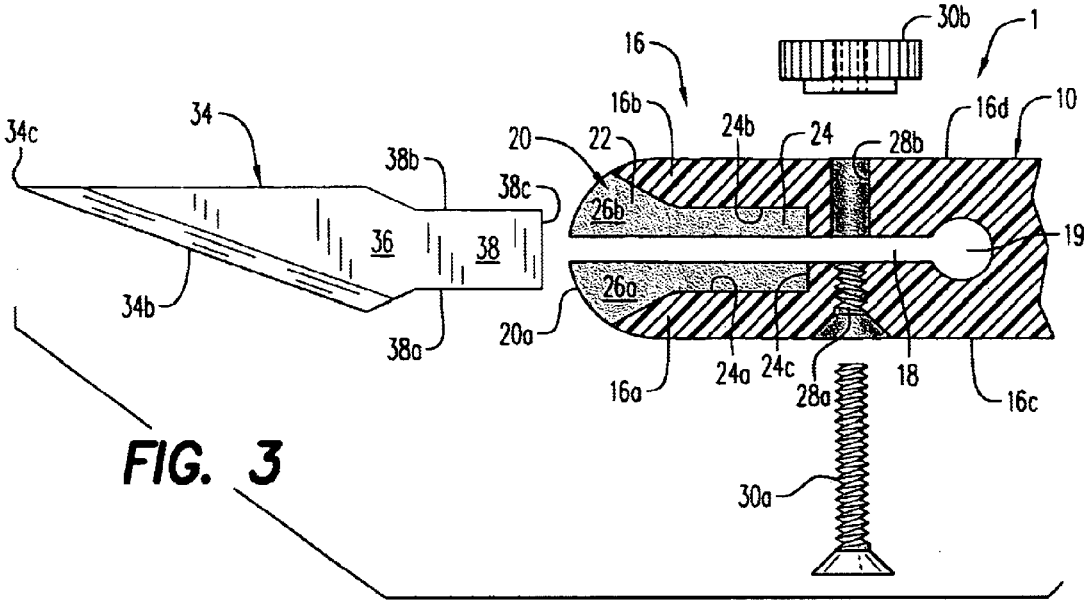
FIG. 3 is an exploded partial longitudinal cross section taken along lines 3—3 of FIG. 1 exposing a typical receptacle slot.
Figure 4:
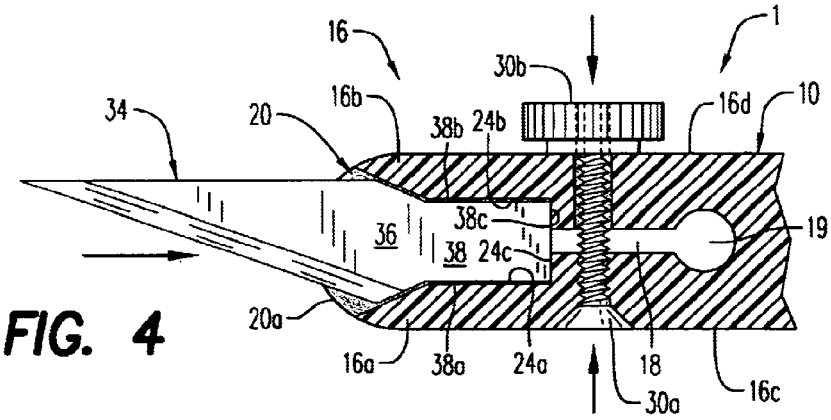
FIG. 4 is a partial longitudinal cross section identical to FIG. 3, but shown fully assembled.
Figure 5:
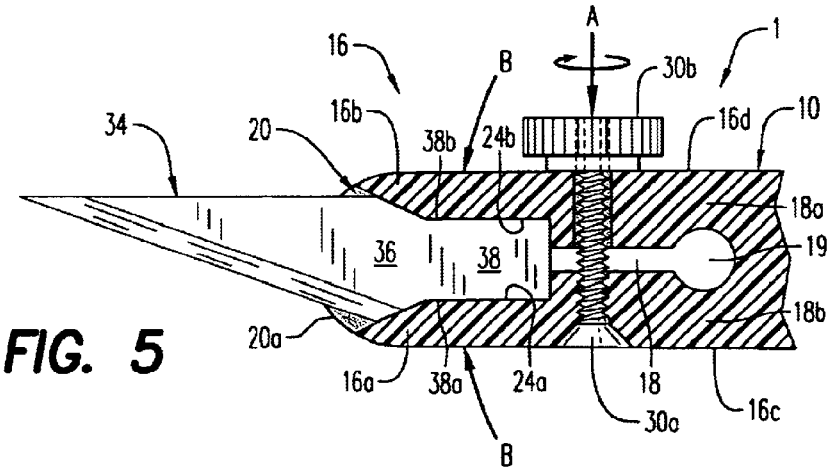
FIG. 5 is a partial longitudinal cross section identical to FIG. 4 but with the blade shown in the "clamped" position.

Referring to FIGS. 1–5, a multi-receptacle blade holder tool 1 consisting of a body 10 generally rectangular in cross section, having a handle portion 12 and a rounded multi-receptacle end 14. The end 14 includes a clamping means 16 comprised of a relief channel 18 which bifurcates end 14 into two portions or legs 16*a* and 16*b* which generally form clamping means 16. The end 14 also includes a plurality of receptacle slots 20 arranged in a stacked configuration for receiving and clamping in place typical #11 hobby blades 34. As seen in FIG. 3, the slots 20 consist of an opening 20*a*, a wide slot portion 22 to accommodate blade shoulder 36, and a narrow slot portion 24 to accommodate blade shank 38 and end wall 24*c* which limits the insertion of blade 34 to a predetermined distance. The slots 20 are further defined by upper and lower surfaces 26*a* and 26*b*, respectively, which are spaced in tight tolerance to blade 34's thickness to ensure a secure fit when a blade is clamped into position. The slots 20 which are also bifurcated by channel 18 include two opposing clamping surfaces 24*a* and 24*b* at the narrow portion 24 of slot 20. Leg 16*a* has a counter-sunk threaded bore 28*a* while leg 16*b* has a non-threaded bore 28*b*. A flat head machine screw 30*a* is threaded into bore 28*a* until it is fully tightened and flush with outer surface 16*c* of leg 16*a*. It passes through bore 28*b* of leg 16*b* with no engagement and protrudes perpendicularly from surface 16*d* of leg 16*b*. A thumbnut 30*b* is threaded onto the protruding threads of screw 30*a* until it contacts surface 16*d* of leg 16*b*. To use the blade holder 1, a blade 34 is then inserted into receptacle slot 20 until the end of blade shank 38*c* contacts end wall 24*c* of slot 20. When thumbnut 30*b* is tightened further, shown as force arrow A, it begins to pinch legs 16*a* and 16*b* together, shown as force arrows B, as they flex at areas 18*a* and 18*b* facilitated by relief channel 18 and relief bore 19. When this flexing occurs, blade 34 is clamped between surfaces 24*a* and 24*b* at edges 38*a* and 38*b* of blade shank 38. This clamping method is capable of holding a single blade or multiple blades in any number of positions to achieve many different desired tool configurations. The blade holder 1 is purposefully designed to have smooth friction free surfaces and radius edges for a comfortable feel and more importantly to protect any adjacent surfaces, structures or materials from damage when blade holder 1 is in use.

Figure 6:
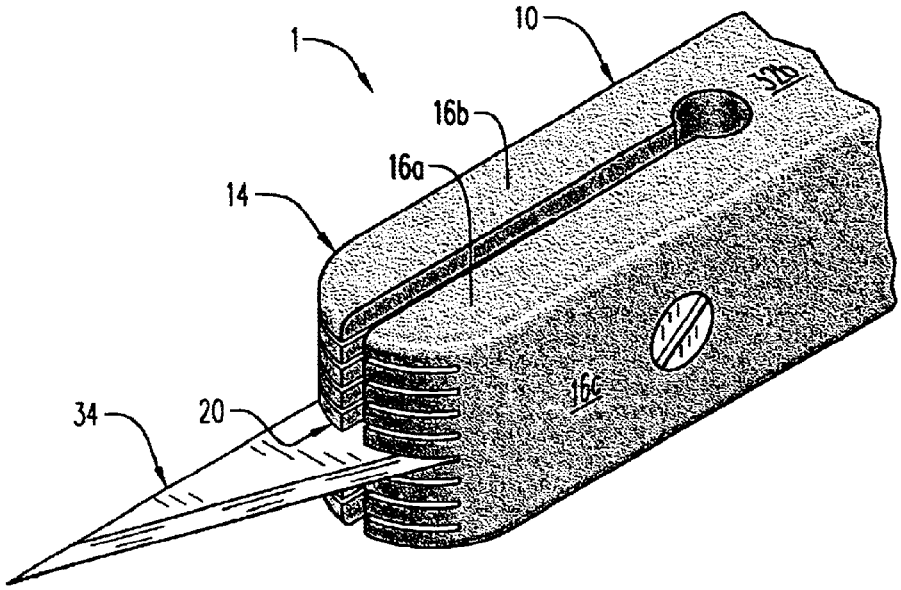
FIG. 6 is a partial isometric view similar to FIG. 1 with the blade shown installed in a right hand position.
Figure 7:
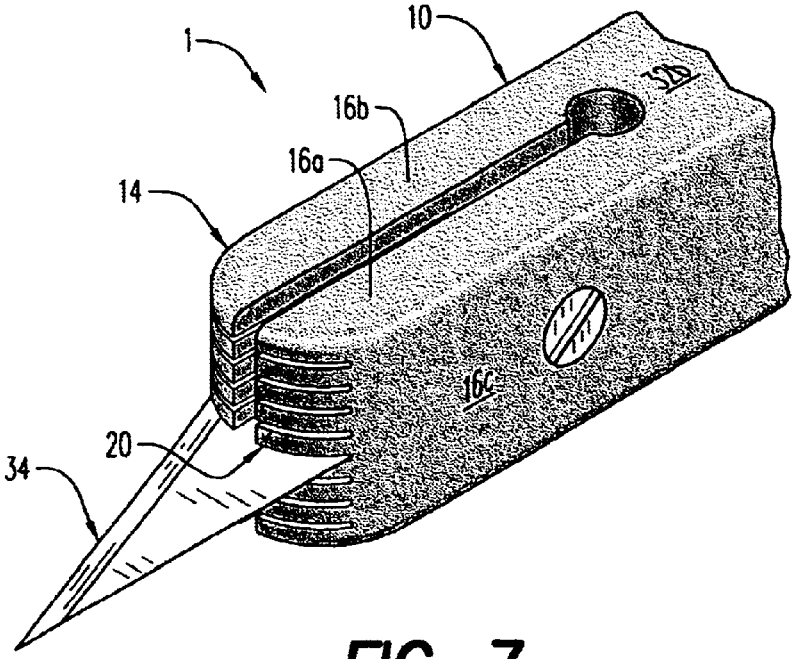
FIG. 7 is a partial isometric view similar to FIG. 6, but with the blade shown in a left hand position.

As can be seen in FIGS. 6 and 7, the blade holder 1 is purposefully designed to be symmetrical and to be able to hold blades 34 in either a right or left handed configuration. This combined symmetry allows the blade holder 1 to be used by right and left handed users without sacrificing functionality or ergonomics. It also allows the blade holder 1 to perform opposite or symmetrical cutting operations by simply loosening thumbnut 30*b*, flipping blade 34 over, and re-tightening thumbnut 30*b*.

Figure 8:
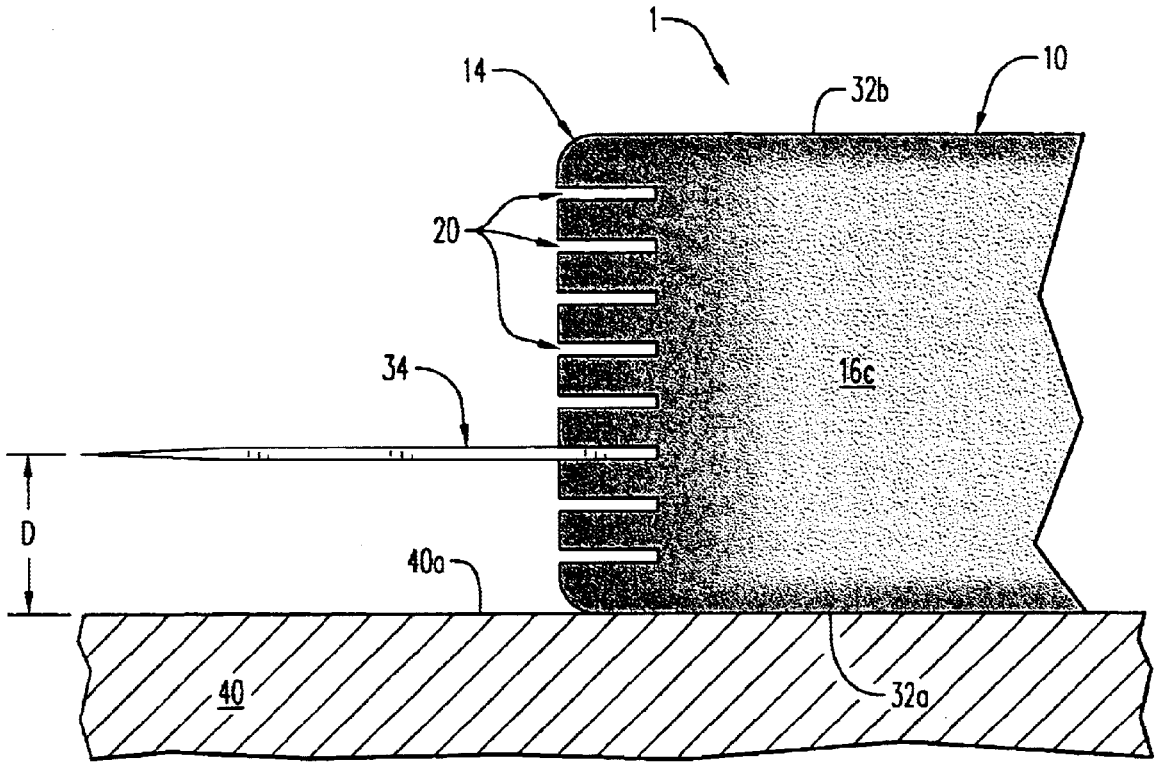
FIG. 8 is a side view of the blade holder illustrating an important feature of the invention's design.

Illustrated in FIG. 8 the blade holder 1 has two smooth guiding surfaces 32*a* and 32*b* which are parallel with slots 20. This parallel orientation of the slots 20 and the guiding surfaces 32*a* and 32*b* allows the blade 34 to be maintained at a predetermined precise distance D from surface 40*a* of structure 40. This distance remains constant even when the holder is slid about the surface 40*a* of structure 40.

Figure 9:
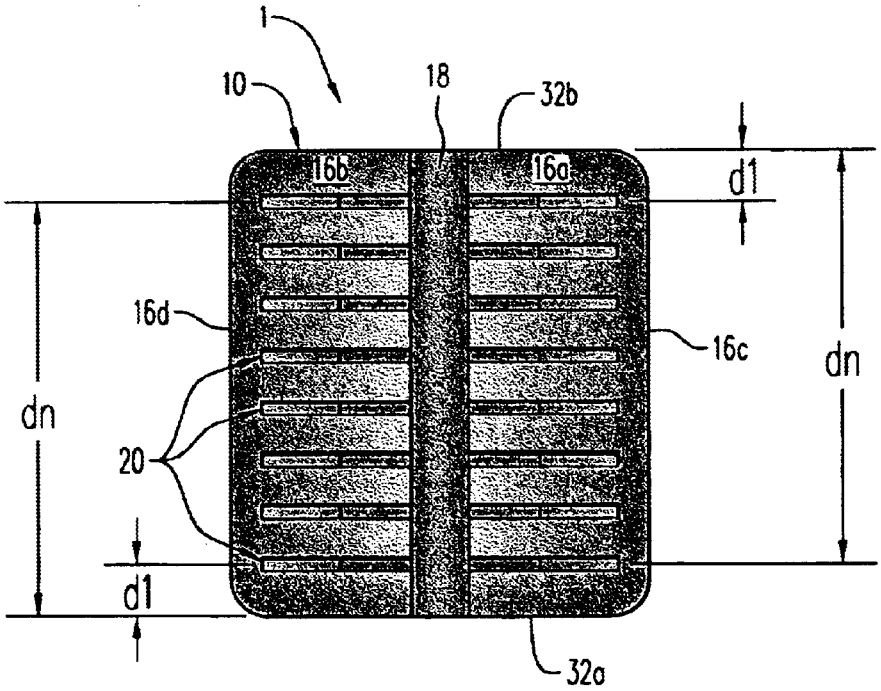
FIG. 9 is a front elevation illustrating the arrangement of the slots and their spatial relationship to the guiding surfaces.

FIG. 9 shows that the receptacle slots 20 are arranged in a stacked configuration and evenly spaced at relatively small increments to facilitate a high degree of distance adjustability d1–dn between the blade 34 (not shown) and the guiding surfaces 32*a* and 32*b*.

Figure 10A:
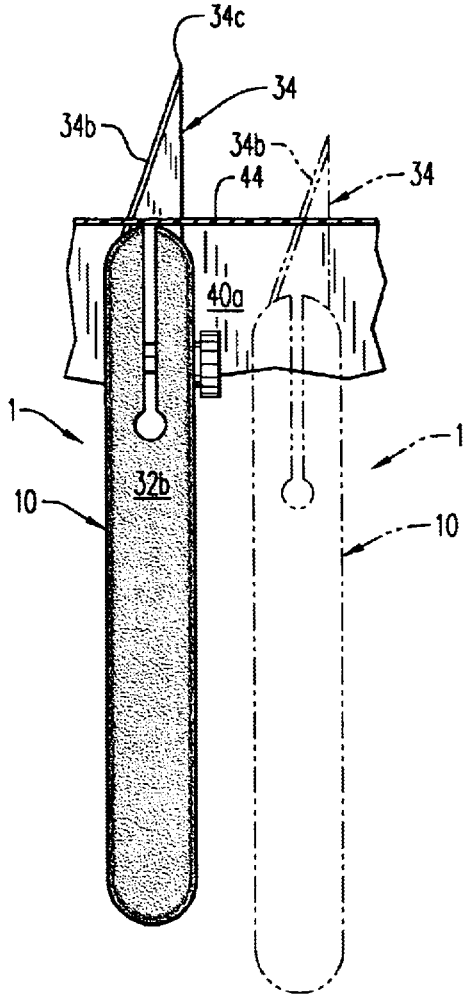
FIG. 10A is a top view of the invention during a cutting operation illustrating one type of "on the fly" adjustability.

As can be demonstrated in FIG. 10A the purposefully designed exposure of the entire sharp edge 34*b* of blade 34 allows the user to skillfully manipulate the depth that the blade 34 penetrates sheet material 44. This on the fly adjustability allows the user to utilize the entire sharp edge 34*b* of blade 34 while performing a cutting operation enabling the use of a sharper less used portion of blade edge 34*b* if difficulties due to dulling of a particular area of blade edge 34*b* are encountered during a cutting operation.

Figure 10B:
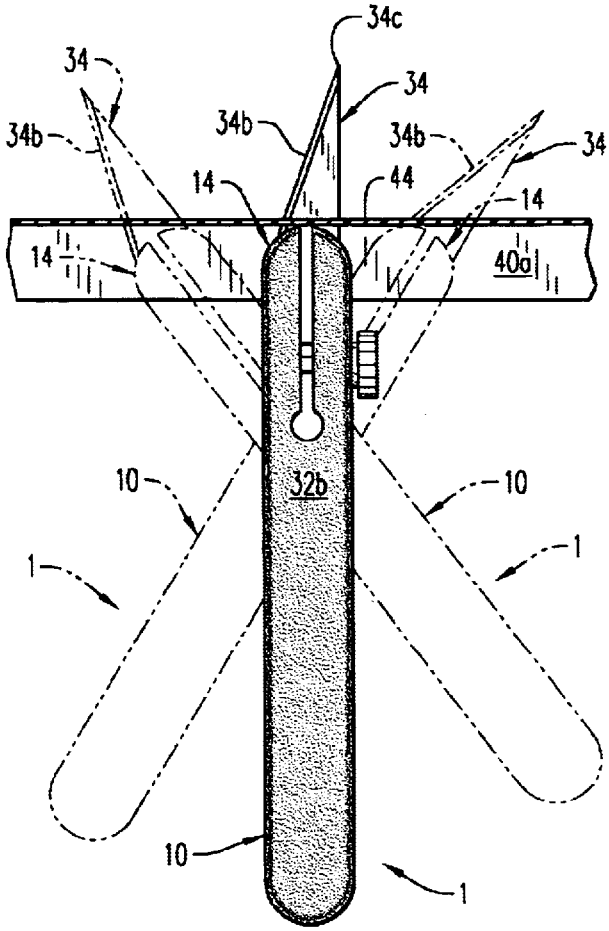
FIG. 10B is a view similar to FIG. 10A illustrating a second type of "on the fly" adjustability.

Another feature demonstrated in FIG. 10B is how the purposefully designed rounded receptacle end 14 of blade holder 1 along with the exposure of the entire sharp edge 34*b* of blade 34 allows the user to greatly vary the angle of attack of blade 34. without interference that would be encountered with a square ended trimmer. when severing sheet material 44. This feature is especially important when structure surface 40*a* is short or shallow. as shown in FIG. 10B, allowing only the small end portion of guiding surface 32*a* or 32*b* to be utilized during a cutting operation. This ability to vary the angle of attack of blade 34 also allows the user to precisely trim into corners and around obstacles in circumstances such as illustrated in FIG. 10B.

In both circumstances illustrated in FIGS. 10A and 10B, the ability to utilize the entire sharp edge 34*b* greatly increases the usable life of blade 34, compared to trimmer tools that only utilize the sharp point 34*c* of blade 34, which dulls very quickly.

Figure 11:
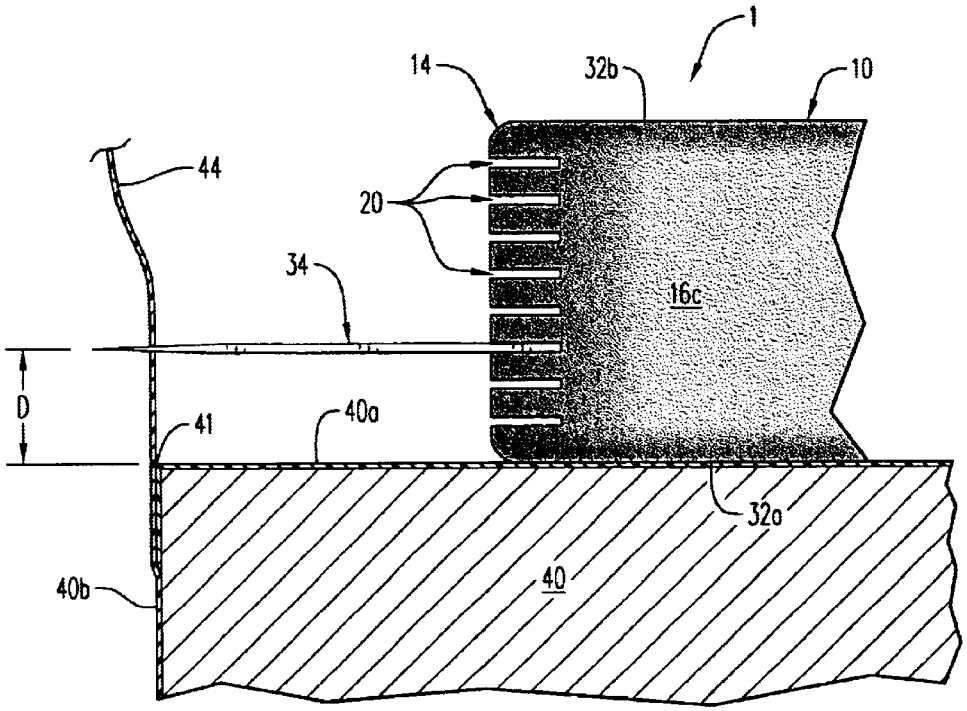
FIG. 11 is a side elevation illustrating a cutting operation at an "outside" edge whereby sheet material is severed precisely at a uniform predetermined distance from the line of intersection of two surfaces.

Shown in FIG. 11 the blade holder 1 is being used to sever sheet material 44 at a precise predetermined overlap distance D from the outside intersection 41 of two surfaces 40*a* and 40*b* of structure 40. Blade holder 1 is slidingly guided along surface 40*a* of structure 40 trimming sheet material 44 which extends from surface 40*b* past the line of intersection 41 extending relatively perpendicular in relation to surface 40*a*, guiding surfaces 32*a* and 32*b*, and cutting plane of blade 34. Once trimmed, the sheet material 44 can be finally applied to surface 40*a* to provide an aesthetic and functional uniform line of overlap.

Figure 12:
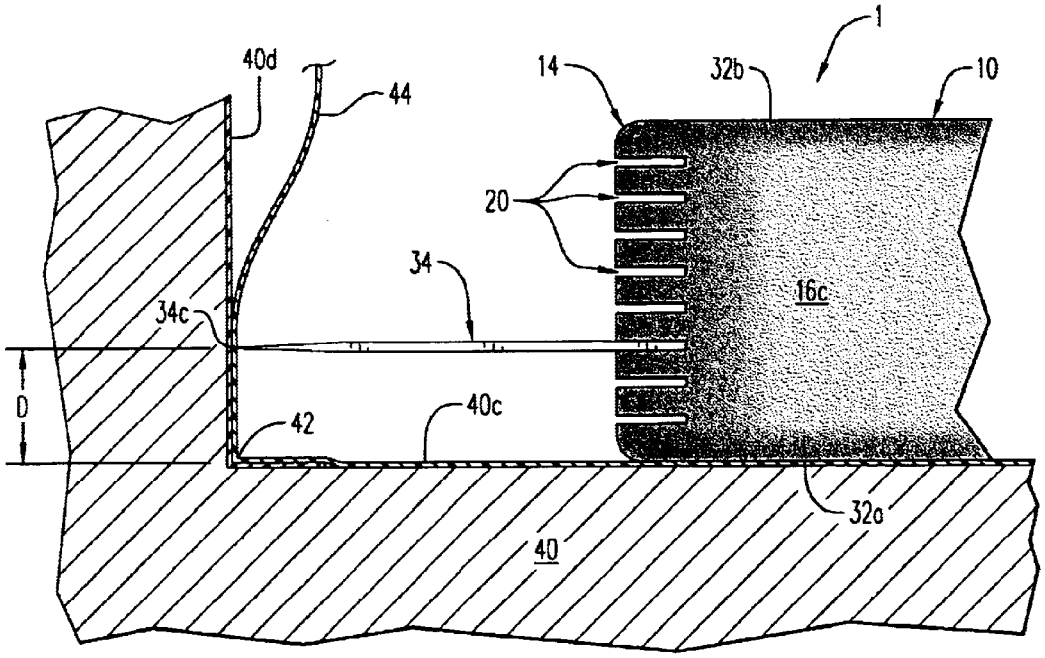
FIG. 12 is a side elevation illustrating a cutting operation at an "inside" edge whereby sheet material is severed precisely at a uniform predetermined distance from the line of intersection of two surfaces.

Shown in FIG. 12 the blade holder 1 is being used to sever sheet material 44 at a predetermined distance D from the inside intersection 42 of two surfaces 40*c* and 40*d* of structure 40. This is achieved by slidingly guiding the blade holder 1 using one of the guiding surfaces 32*a* or 32*b* along structure surface 40*c* allowing tip 34*c* of blade 34 to pierce and sever sheet material 44 taking care not to penetrate too deeply into structure surface 40*d*. Once trimmed, the sheet material 44 can be finally applied to surface 40*d* to provide an aesthetic and functional uniform line of overlap.

Figure 13:
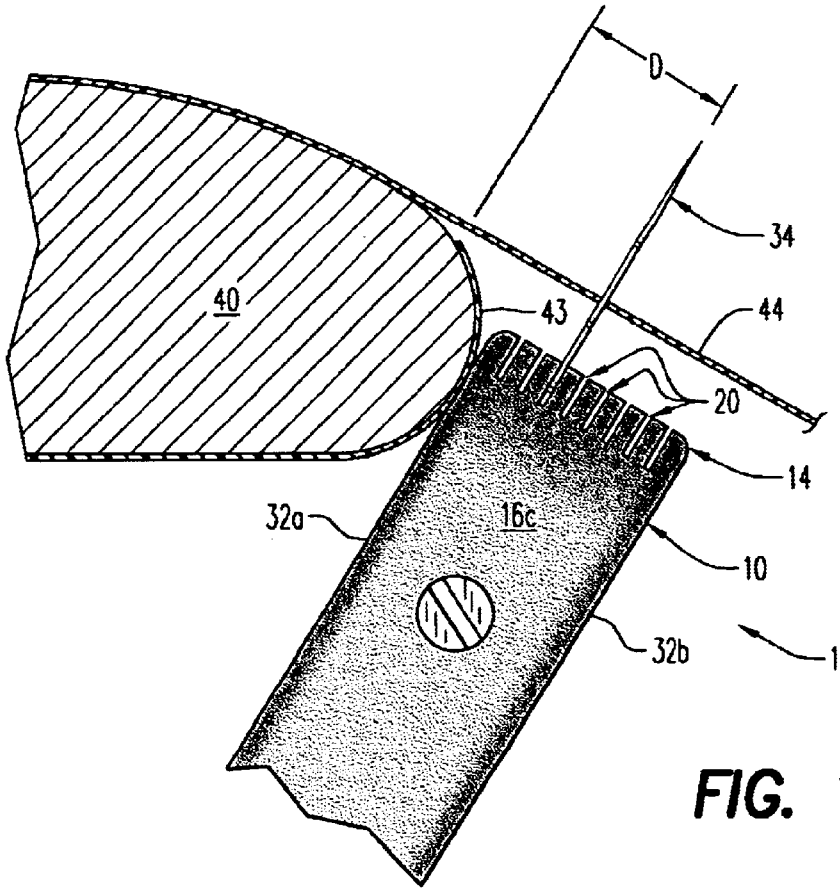
FIG. 13 is a side elevation illustrating a cutting operation performed by slidingly guiding the tool tangentially on a rounded corner of a structure severing sheet material precisely at a uniform predetermined distance of overlap.

A similar cutting operation is depicted in FIG. 13 where blade holder 1 can be slidingly guided tangentially on curved or rounded corner of structure 40, trimming sheet material 44 at a precise predetermined distance D of overlap. Once trimmed, the sheet material 44 can be finally applied to corner 40*c* to provide an aesthetic and functional uniform line of overlap.

Figure 14:
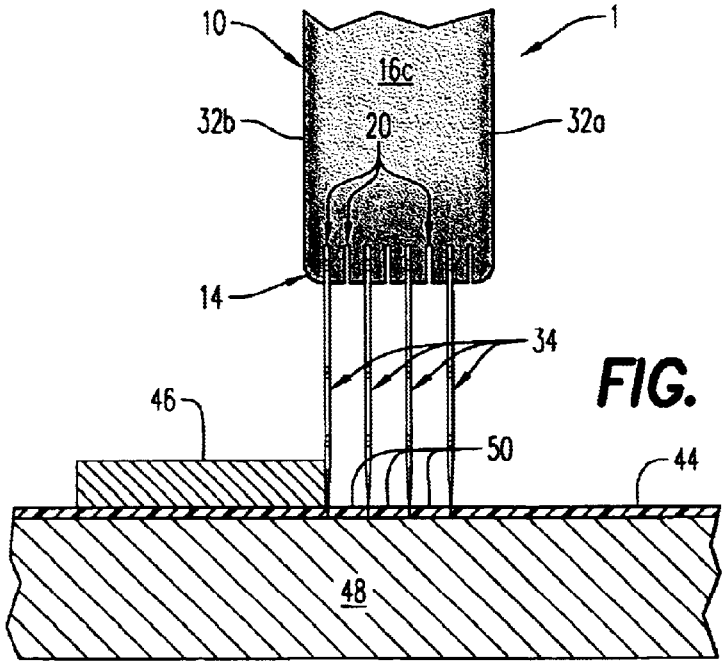
FIG. 14 is a side elevation illustrating the tool being used to cut "pinstripes" with the aid of a straightedge.
Figure 15:
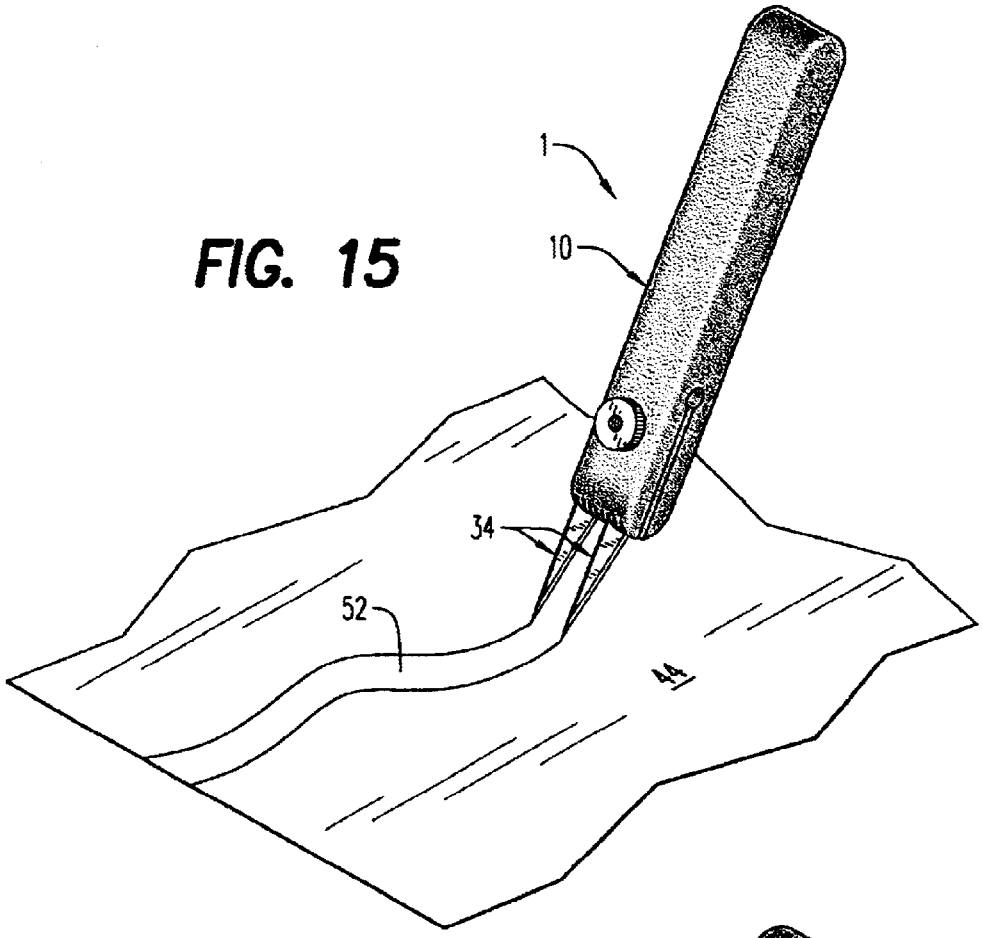
FIG. 15 is an isometric view of the blade holder tool being used to cut freehand or non-linear "pin-striping"
Figure 16:
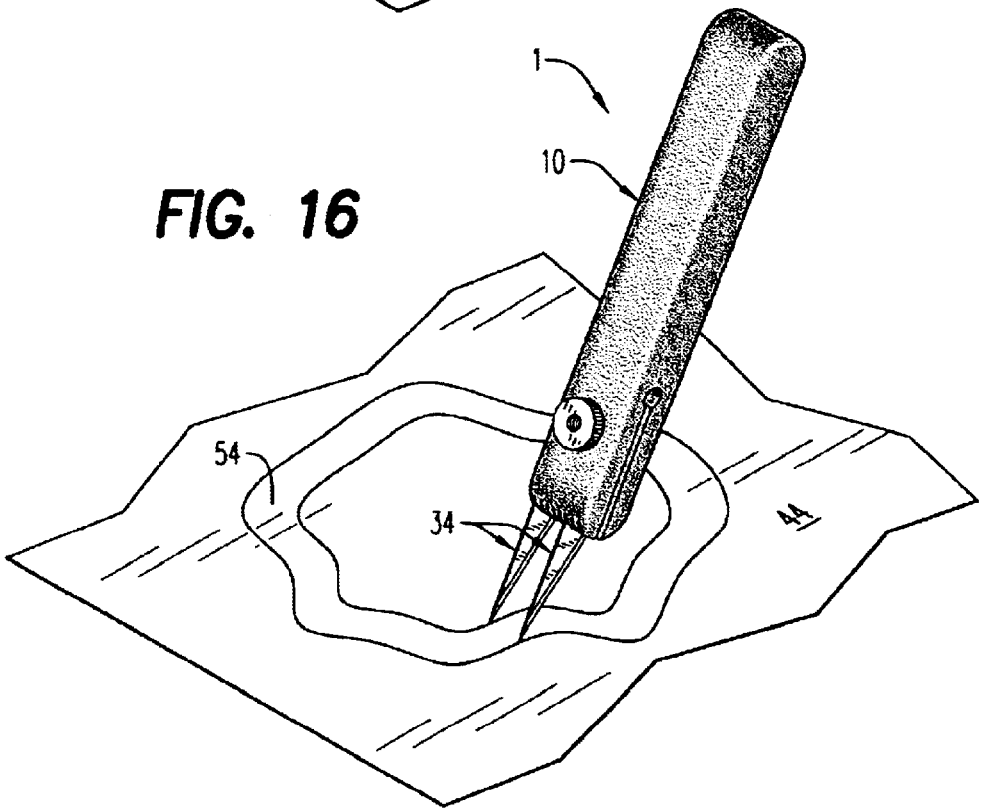
FIG. 16 is an isometric view illustrating the blade holder tool being used to cut a shape with a uniform width or border.

Some other cutting operations are illustrated in FIGS. 14–16. Pin-striping can be cut from sheet material 44 with blade holder 1 in any number of ways by selectively configuring blades 34 to cut the desired width and number of stripes 50. By using a suitable cutting surface 48, these stripes 50 can be made linear such as with a straightedge 46, or as shown in FIG. 15, more organic freehand curves 52. This multiple blade configuration could also be used, with or without the use of a template (not shown), to cut designs, letters, numbers or shapes 54, for example, from sheet material 44 with a uniform width or border as illustrated in FIG. 16.

Figure 1:
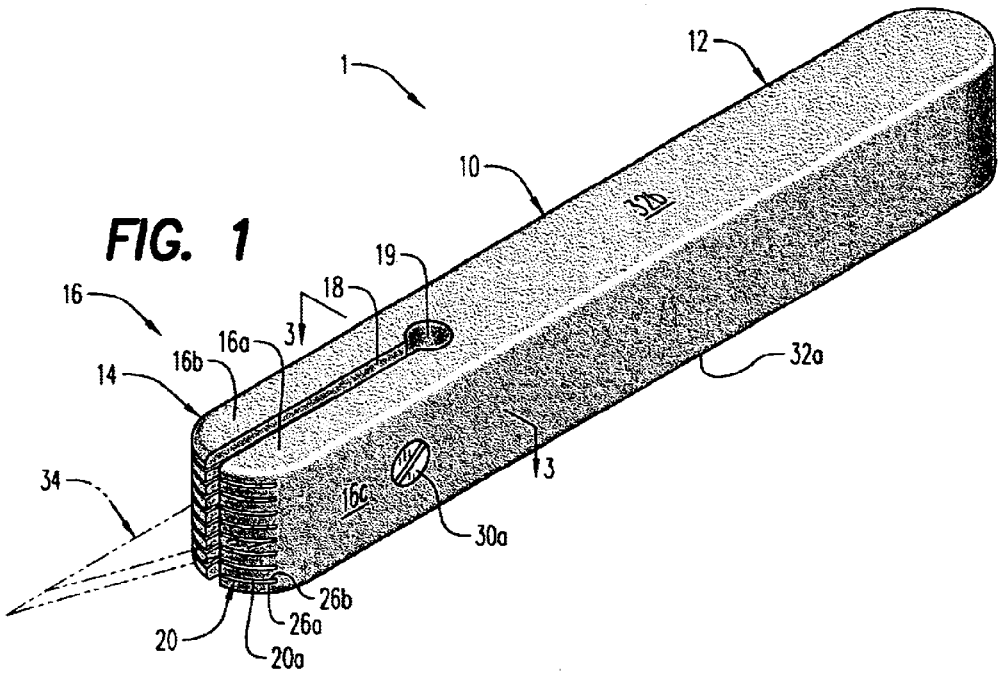
FIG. 1 is a right hand isometric view of the blade holder tool invention.
Figure 2:
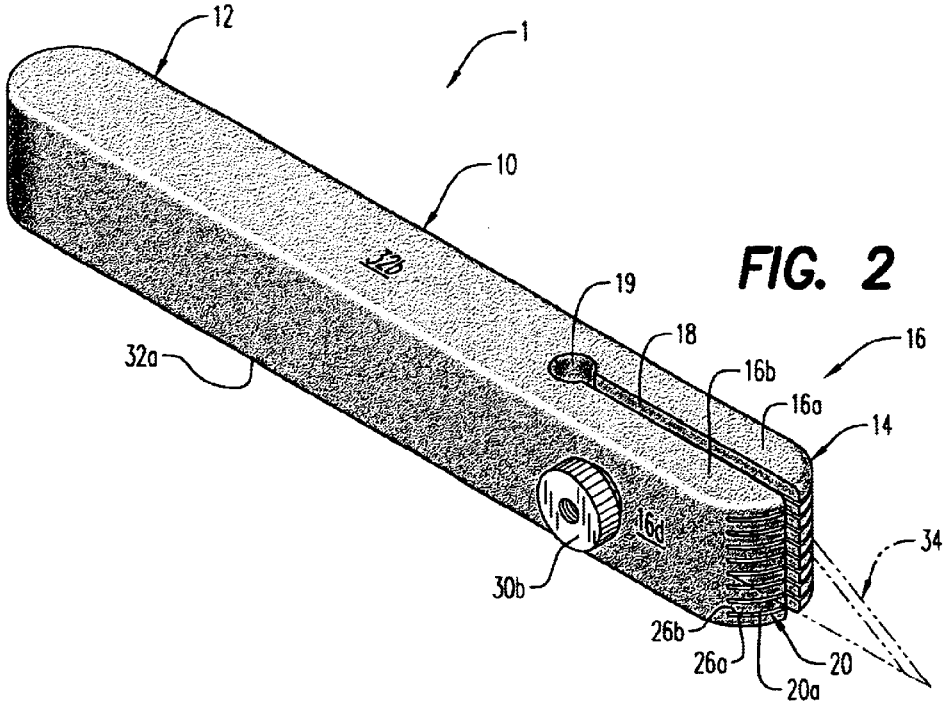
FIG. 2 is a left hand isometric view of the blade holder tool invention.

Blade holder 1 can also be used simply to hold a single blade 34, as shown in FIG. 1, to perform any variety of cutting tasks.

Although the preferred embodiment of the present invention has been explained in detail, hereinabove, the present invention should not be limited to this embodiment alone, but various modifications and changes can be made thereto without departing from the scope of the invention defined in the appended claims.

What is claimed is:

1. A sheet material cutting tool comprising:

a body defining a bottom guide surface; a front surface; a channel extending transversely to said bottom guide surface and intersecting said front surface; a first leg and a second leg straddling said channel and each forming a portion of said bottom guide surface; at least one slot defined by said first and second legs and transversely intersecting said channel, said slot being parallel to said bottom guide surface and shaped to receive the shank of a blade; and closure means actuatable to produce a force clamping the shank between said legs.

2. A tool according to claim 1 wherein said front surface is convex and, radially intersected by said slot.

3. A tool according to claim 2 wherein said front surface is symmetrical around said slot.

4. A tool according to claim 3 wherein said body comprises a top guide surface parallel to said bottom surface.

5. A tool according to claim 4 wherein said first and second legs define a cavity for receiving the shank and said slot includes a rear portion extending rearwardly of said cavity.

6. A tool according to claim 5 wherein said closure means comprises a tightening mechanism extending between said first and second legs and through said rear portion of said slot.

7. A tool according to claim 6 wherein said cavity is rectangular.

8. A tool according to claim 7 wherein said slot further includes a fan-shaped portion extending between said cavity and said front surface.

9. A tool according to claim 8 wherein said slot further includes a transversely enlarged opening terminating an inner end of said rear portion and extending between said top surface and said bottom surface.

10. A tool according to claim 1 wherein said tool comprises a plurality of said slots.

11. A tool according to claim 10 wherein said front surface is convex and, radially intersected by said slots.

12. A tool according to claim 11 wherein said front surface is symmetrical around said slots.

13. A tool according to claim 12 wherein said body comprises a top guide surface parallel to said bottom surface.

14. A tool according to claim 13 wherein said first and second legs define a cavity for receiving the shank and said slots include a rear portion extending rearwardly of said cavity.

15. A tool according to claim 14 wherein said closure means comprises a tightening mechanism extending between said first and second legs and through said rear portion of said slots.

16. A tool according to claim 15 wherein said cavity is rectangular.

17. A tool according to claim 16 wherein said slots further include a fan-shaped portion extending between said cavity and said front surface.

18. A tool according to claim 17 wherein said slots further include a transversely enlarged opening terminating an inner end of said rear portion and extending between said top surface and said bottom surface.

19. A tool according to claim 10 wherein said slots are uniformly spaced apart.

20. A tool according to claim 19 wherein said front surface is convex and, radially intersected by said slots.

* * * * *